US008763186B2

(12) United States Patent
Mosey et al.

(10) Patent No.: US 8,763,186 B2
(45) Date of Patent: Jul. 1, 2014

(54) MECHANISM AND METHOD FOR LIFTING A WHEELCHAIR

(71) Applicants: Stephen Mosey, Richmond, IN (US); George Mosey, Richmond, IN (US)

(72) Inventors: Stephen Mosey, Richmond, IN (US); George Mosey, Richmond, IN (US)

( * ) Notice: Subject to any disclaimer, the term of this patent is extended or adjusted under 35 U.S.C. 154(b) by 0 days.

(21) Appl. No.: 13/748,143

(22) Filed: Jan. 23, 2013

(65) Prior Publication Data

US 2014/0123411 A1 May 8, 2014

Related U.S. Application Data

(60) Provisional application No. 61/722,972, filed on Nov. 6, 2012.

(51) Int. Cl.
*A61G 3/06* (2006.01)
*B66B 9/08* (2006.01)

(52) U.S. Cl.
USPC ..... 14/71.3; 414/921

(58) Field of Classification Search
USPC ..... 14/71.3; 414/546, 921; 187/200
IPC ..... A61G 3/02,3/04, 3/06, 3/08; B66B 9/08
See application file for complete search history.

(56) References Cited

U.S. PATENT DOCUMENTS

| | | | | |
|---|---|---|---|---|
| 4,155,468 | A * | 5/1979 | Royce | 414/556 |
| 5,261,779 | A * | 11/1993 | Goodrich | 414/546 |
| 5,556,250 | A * | 9/1996 | Fretwell et al. | 414/558 |
| 5,947,231 | A * | 9/1999 | Raab et al. | 187/200 |
| 5,975,830 | A * | 11/1999 | Goodrich et al. | 414/541 |
| 6,357,992 | B1 * | 3/2002 | Ringdahl et al. | 414/545 |
| 6,558,106 | B2 * | 5/2003 | Sardonico | 414/556 |
| 2006/0087166 | A1 * | 4/2006 | Trippensee et al. | 297/338 |
| 2011/0268544 | A1 * | 11/2011 | Koretsky et al. | 414/523 |

FOREIGN PATENT DOCUMENTS

JP 2010-241605 * 10/2010

* cited by examiner

*Primary Examiner* — Gary Hartmann

(57) ABSTRACT

A method of raising a wheelchair compartment from a non-horizontal ramp position to an approximately horizontal safe position comprises providing a lift mechanism comprising an elevator structure, a wheelchair compartment configured to hold a wheelchair and rotatable from the ramp position to the safe position, a cam connected to the compartment and comprising a cam contact surface, a cam arm connected to the elevator structure and rotatable about a pivot pin, an actuator connected between the elevator structure and the cam arm and configured to rotate the cam arm relative to the pivot pin, and a cam arm bearing connected to the cam arm and configured to press against the cam contact surface of the cam. The method includes operating the actuator when the wheelchair compartment is in the ramp position so as to cause the wheelchair compartment to rise to the safe position.

9 Claims, 5 Drawing Sheets

MECHANISM AND METHOD FOR LIFTING A WHEELCHAIR

REFERENCE TO RELATED APPLICATION

This application claims priority to U.S. Provisional Patent Application No. 61/722,972, filed Nov. 6, 2012, entitled "A MECHANISM FOR LIFTING A WHEELCHAIR."

BACKGROUND OF THE INVENTION

The present invention relates to wheelchairs and, more particularly, to a mechanism for lifting a wheel chair.

Currently, many people use wheelchairs in their daily lives to move around. Navigating with a wheelchair can be difficult, especially if the person in the wheelchair has to be removed from the wheelchair every time they have to enter a vehicle.

Wheelchair lifts are commonly utilized to lift wheelchairs into SUV's and like size vehicles. However, the lifts of the prior art use a mechanism that is somewhat cumbersome.

Therefore, there is a need for a wheelchair lift that can smoothly lift the occupant off of the ground into a safe position. There is also a need for a wheelchair lift that an occupant can easily exit in the event that the mechanism malfunctions.

As can be seen, there is a need for solutions to these and other problems.

SUMMARY OF THE INVENTION

In one aspect of the present invention, a method of raising a wheelchair compartment from a non-horizontal ramp position to an approximately horizontal safe position, comprises: providing a lift mechanism comprising: an elevator structure; a wheelchair compartment configured to hold a wheelchair and rotatable from the ramp position to the safe position; a cam connected to the compartment and comprising a cam contact surface; a cam arm connected to the elevator structure and rotatable about a pivot pin, the cam arm having a first side and a second side opposite the first side relative to the pivot pin; an actuator connected between the elevator structure and the first side of the cam arm and configured to rotate the cam arm relative to the pivot pin; and a cam arm bearing connected to the second side of the cam arm and configured to press against the cam contact surface of the cam; and operating the actuator when the wheelchair compartment is in the ramp position so as to cause the wheelchair compartment to rise to the safe position.

In one aspect, when the wheelchair compartment is in the safe position, the cam arm is beyond top dead center, whereby a torque must be applied to the cam arm to allow the wheelchair compartment to lower to the ramp position.

In one aspect, the lift mechanism further comprises a door rotatably connected to the wheelchair compartment about a hinge, the door serving as a wheelchair ramp to the wheelchair compartment when in an open position. In one aspect, the lift mechanism further comprises a door linkage release pin connected to the door, and wherein the method further comprises pulling the door linkage release pin to release the door to fall open.

In one aspect, the method further comprises closing the door at a rate to correspond to a rate of raising of the wheelchair compartment so that when the wheelchair compartment is in the ramp position, the door is in the open position, and when the wheelchair compartment is in the safe position, the door is in a fully closed position. In one aspect, the door is connected via linkages to the cam arm, and wherein the step of operating the actuator when the wheelchair compartment is in the ramp position also causes the door to close from the open position to a fully closed position.

In one aspect, the method further comprises operating the actuator when the wheelchair compartment is in the safe position so as to cause the wheelchair compartment to lower to the ramp position. In one aspect, the step of operating the actuator comprises operating the actuator so as to cause the wheelchair compartment to rise to the safe position at an approximately constant rate.

In one aspect, a method of removing a wheelchair compartment comprises: providing a lift mechanism for raising a wheelchair compartment from a non-horizontal ramp position to an approximately horizontal safe position, comprising: an elevator structure; a wheelchair compartment configured to hold a wheelchair and rotatable from the ramp position to the safe position; a cam connected to the compartment and comprising a cam contact surface; a cam arm connected to the elevator structure and rotatable about a pivot pin, the cam arm having a first side and a second side opposite the first side relative to the pivot pin; an actuator connected between the elevator structure and the first side of the cam arm and configured to rotate the cam arm relative to the pivot pin; and a cam arm bearing pin connected to the second side of the cam arm and configured to press against the cam contact surface of the cam, wherein operation of the actuator when the wheelchair compartment is in the ramp position causes the wheelchair compartment to rise to the safe position; and lifting the wheelchair compartment upward so that the cam arm no longer presses against the cam contact surface of the cam and the wheelchair compartment no longer has contact with the elevator structure.

These and other features, aspects and advantages of the present invention will become better understood with reference to the following drawings, description and claims.

DETAILED DESCRIPTION OF THE INVENTION

Figure 1:
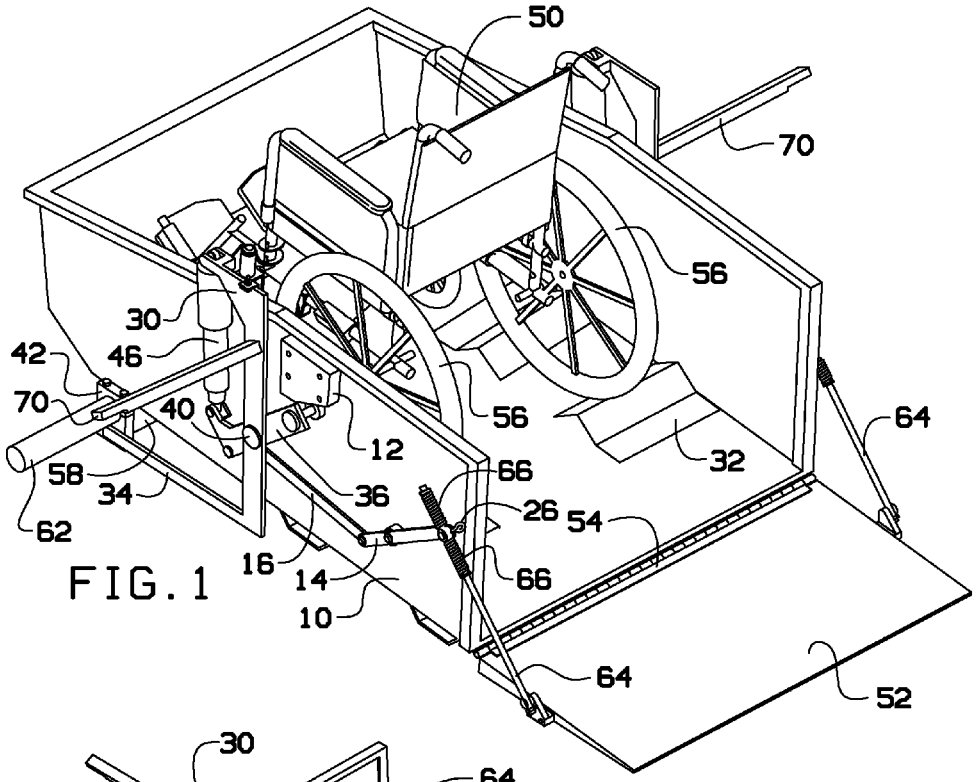
FIG. 1: is a rear perspective view of the invention shown in use.
Figure 2:
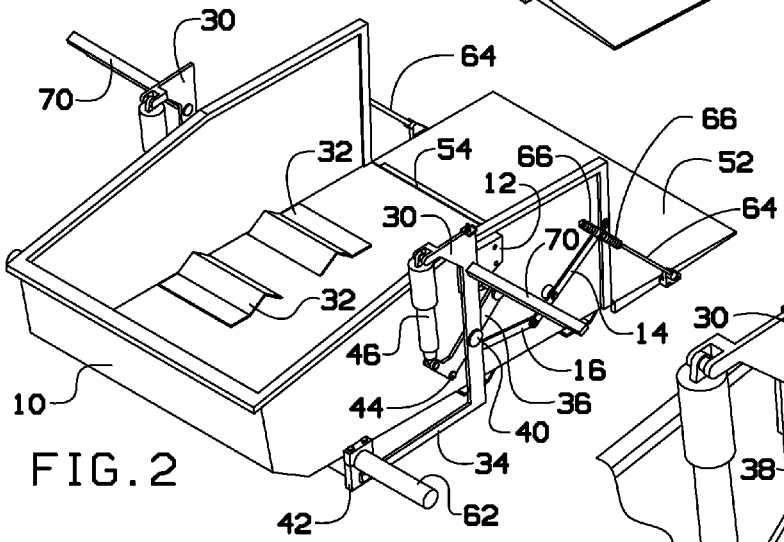
FIG. 2: is a forward perspective view of the invention.
Figure 3:
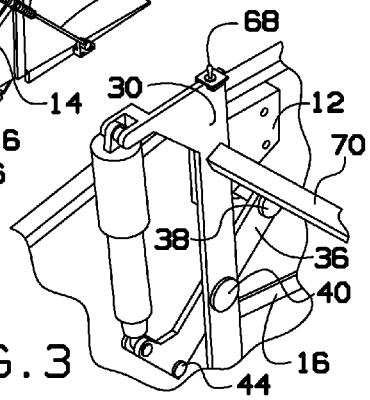
FIG. 3: is a forward perspective detail view of the invention illustrating primary operational components.
Figures 4, 5, 6:
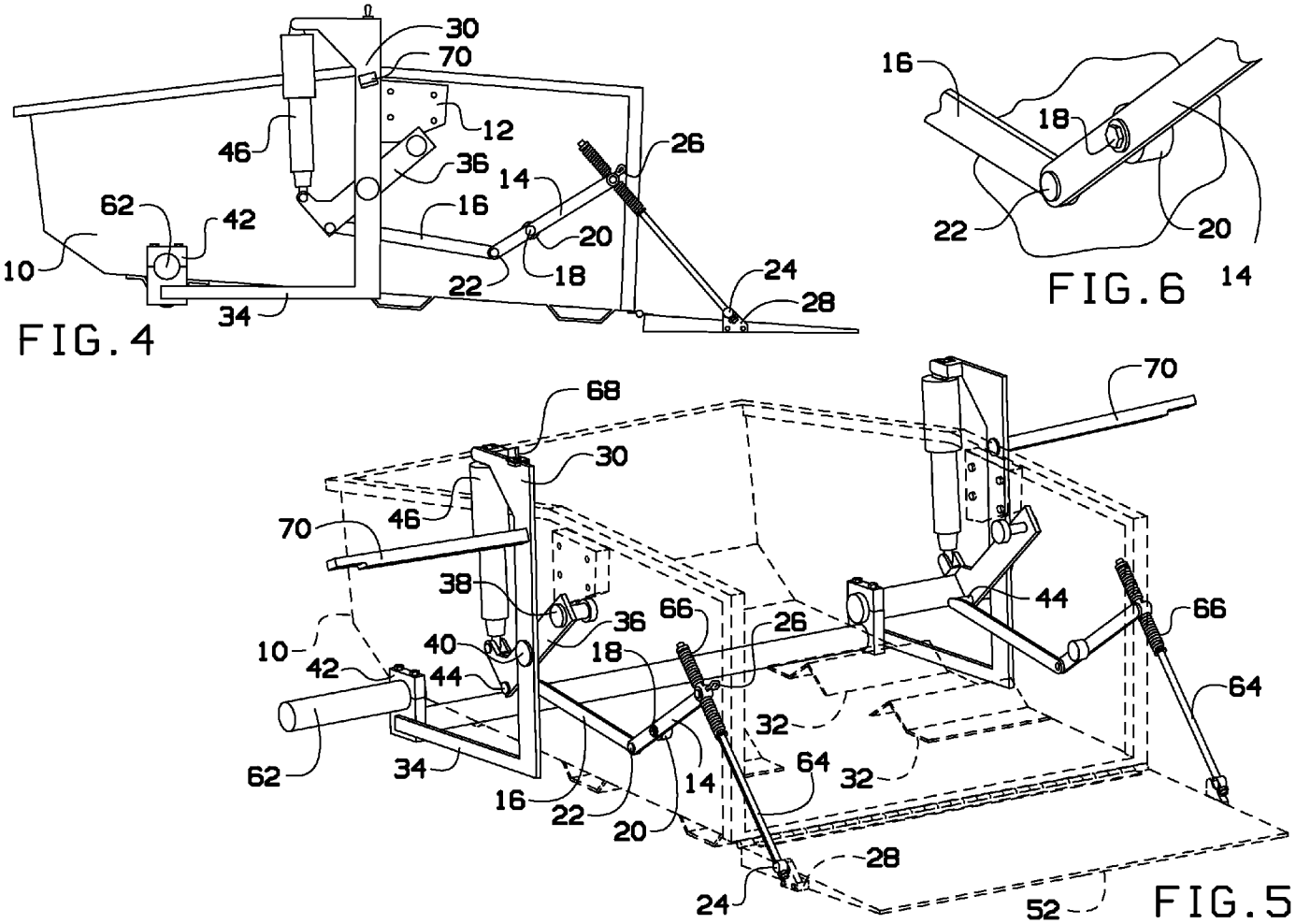
FIG. 4: is a side view of the invention shown in open/lowered configuration.
FIG. 5: is a rear perspective view of the invention shown in open/lowered configuration.
FIG. 6: is a rear perspective detail view of the invention illustrating primary door/ramp linkage components.
Figure 9:
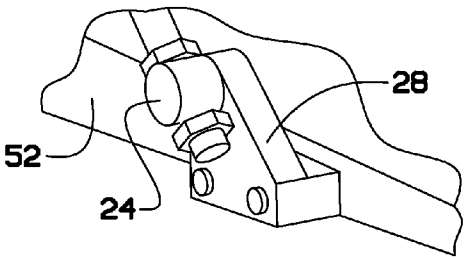
FIG. 9: is a rear perspective detail view of the invention illustrating primary door/ramp linkage components.
Figure 7:
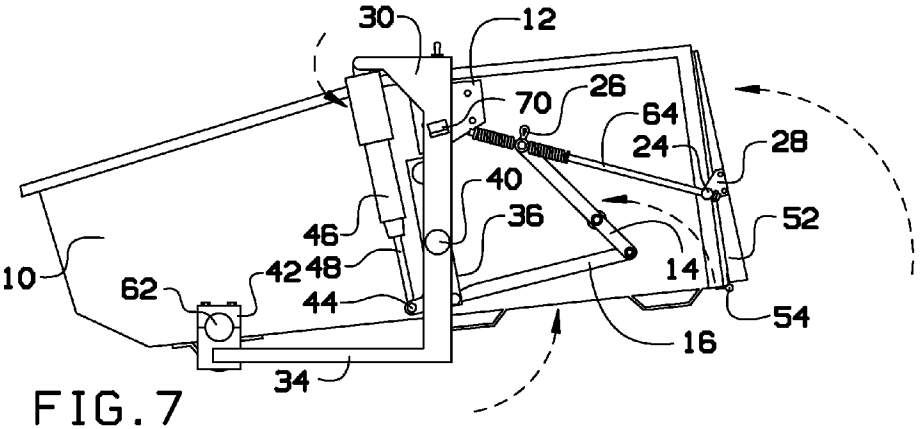
FIG. 7: is a side view of the invention shown in closed/raised configuration.
Figure 8:
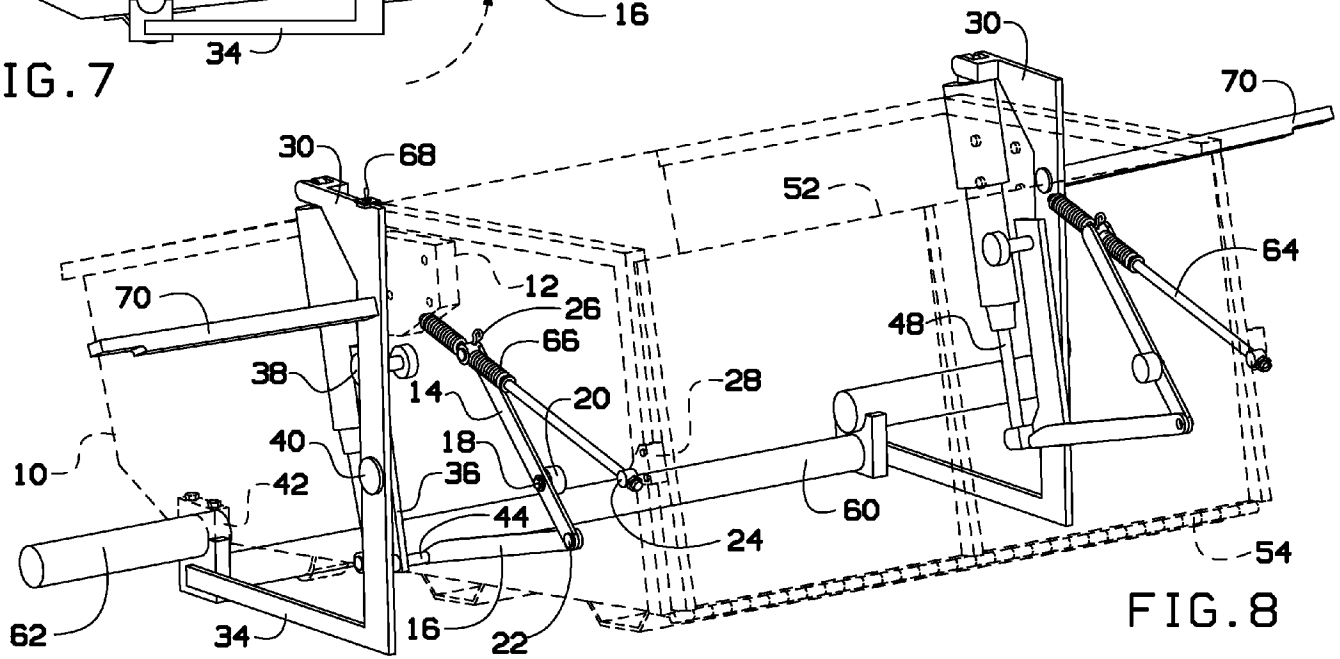
FIG. 8: is a rear perspective view of the invention shown in closed/raised configuration.
Figure 10:
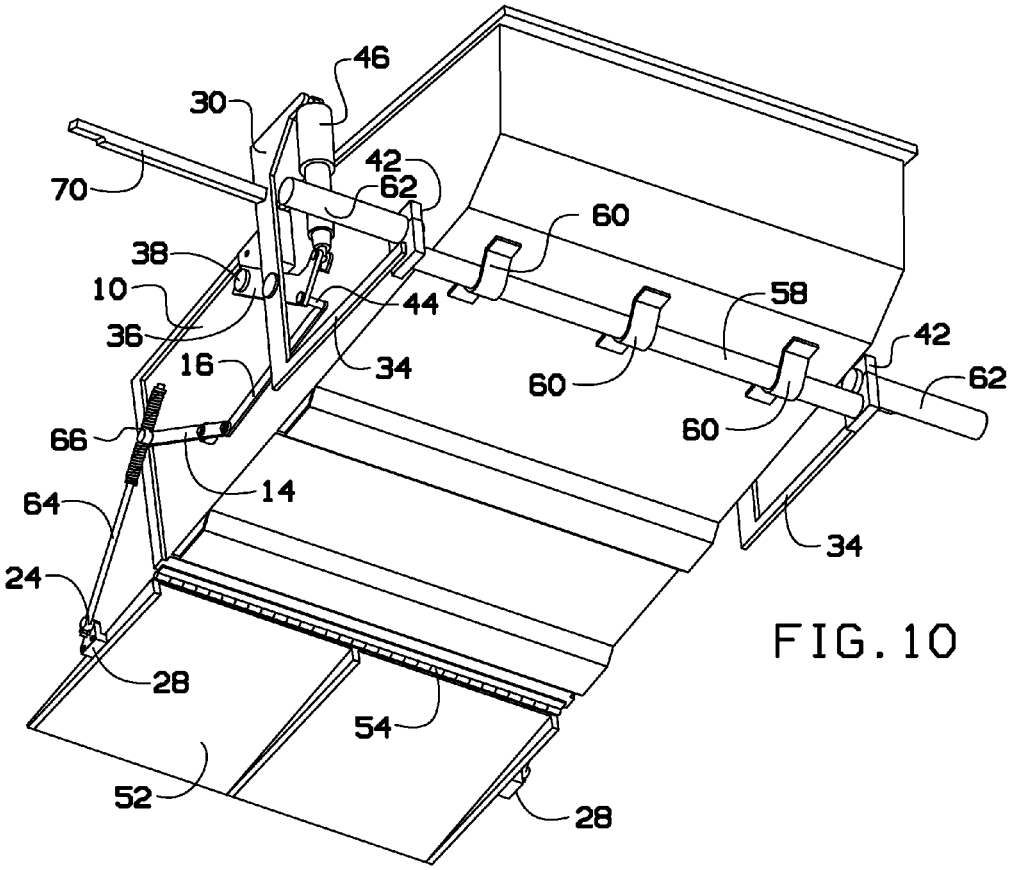
FIG. 10: shows a perspective view of one embodiment of the present invention.
Figure 11:
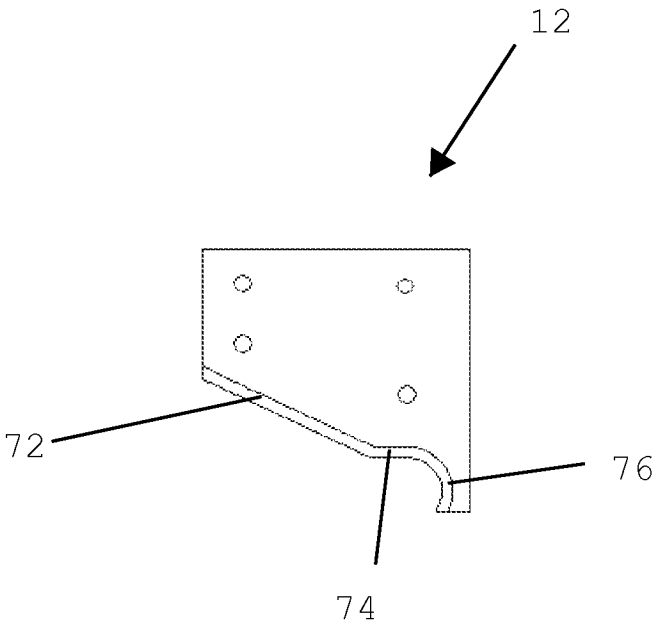
FIG. 11: shows a side view of a cam according to one embodiment of the present invention.

The following detailed description is of the best currently contemplated modes of carrying out exemplary embodiments of the invention. The description is not to be taken in a limiting sense, but is made merely for the purpose of illustrating the general principles of the invention.

Referring now to the figures, the following reference numbers refer to the designated elements:

10: is the bucket weldment or wheelchair compartment.
12: is the elevator cam.
14: is the door linkage middle lever
16: is the door linkage front lever.
18: is the door linkage pivot pin.
20: is the door linkage pivot pin mount.
22: is the door linkage front pin.
24: is the door linkage rear pin.
26: is the door linkage release pin.
28: is the door linkage lever mount
30: is the elevator mount weldment.
32: is the wheel chair chock.
34: is the elevator brace.
36: is the cam arm weldment.
38: is the cam arm bearing pin.
40: is the pivot pin.
42: is the drop bar clamp.
44: is the bucket door mounting pin.
46: is the Lenco actuator body.
48: is the Lenco actuator rod.
50: is the exemplary wheel chair.
52: is the door.
54: is the door hinge.
56: is the exemplary wheel chair wheel.
58: is the pivot axel.
60: is the pivot axel U-clamp.
62: is the rod to mount to the parent device.
64: is the door linkage shaft.
66: is the door linkage shaft compression spring.
68: is the toggle switch.
70: is the elevator support post welded to parent device.
72: is the raising region surface.
74: is the raised region surface.
76: is the stop region surface.

Broadly, an embodiment of the present invention provides a wheelchair lift for lifting a person in a wheelchair from a ramped position to a transport or ride position.

Referring now to the figures, the design of this device provides a safe environment for a wheelchair while riding in the ramp even when the electric component of this device fails.

Wheelchair lifts of the prior art are typically 1 or 2 feet off of the ground making it difficult to employ the emergency exit system of the current invention. This device is very low to the ground, such as 4 to 5 inches, so if the device fails and emergency exit is required the resulting gradient angle on exit makes it safe to exit without toppling the wheelchair.

In one embodiment of the invention, an upper support post is welded to the parent machine frame. An elevator mount is inserted on to this post. An elevator brace is welded to the elevator mount. A drop bar clamp is welded to the elevator brace. An elevator mount pin is welded to the elevator mount. A bronze bushing is inserted into the cam arm. A steel shim is installed on both sides of the cam arm. A cam arm weld nut is welded to the elevator mount pin. A cam arm bearing pin is inserted and welded into the cam arm. A ball bearing is installed onto the cam arm bearing pin. A cam arm bearing retaining washer is installed onto the cam arm bearing pin. A button head screw is installed thru the cam arm bearing retaining washer and into the cam arm bearing pin. An electric actuator is installed onto the elevator mount by means of 2 shoulder screws and secured by 1 actuator spacer and 2 flange lock nuts.

The combined elements of the elevator system work together to lift the wheelchair and its occupant off of the ground via contact with cam plates located on the wheelchair compartment while rotating around a common round support bar at the front of the parent device, thus swinging on an arc to achieve the same level of clearance at the rear of the parent device as is at the front of the parent device. At the same time the ramp of the parent device which is also attached to the elevator system lifts up to form the rear door of the parent device which is achieved in one smooth action by the elevator system. The ramp lift system which is hooked to the elevator system has a mechanical link that can be disconnected by the occupant thus letting the ramp drop down to a ramp position in the event that there is a malfunction with the elevator system. Therefore, in the event of a malfunction of the device, the occupant is able to safely exit the parent vehicle. This door lift mechanism is an integral part of the elevator system application features because of its disconnection feature.

An exemplary embodiment of the invention can be deployed to efficiently move a load from point "A" to point "B" by employing an electrical current to a motor thus turning a linear actuator screw and exerting force on a lever that rotates around a common axle. The radius of swing of the cam arm determines the amount of lift until the arc is at top dead center at which point maximum lift is achieved. The mechanism of this invention goes 2 or 3 degrees past top dead center thus providing an additional degree of safety in the event of a physical disconnection of the linear device for any reason. The ball bearing would simply rest against the dead stop at the end of the cam plate and because it is already past dead center and it is trapped and cannot move backward unless it is pulled backward by the linear actuator.

No other lifts in the prior art use cams as a means of movement; rather, they use interconnected levers to exert movement. Also, since the cam is not mechanically attached to the lever that operates it, the compartment that the cam is attached to can be easily removed for periodic maintenance of the host device (where the host device houses the lever and the wheelchair compartment houses the cam).

Referring to the drawings, a lift mechanism for lifting a wheelchair compartment from a non-horizontal ramp position to an approximately horizontal safe position, comprising:

an elevator structure (which could include elements 70, 34, 30, etc.);

a wheelchair compartment 10 configured to hold a wheelchair 50 and rotatable from the ramp position to the safe position;

a cam 12 connected to the compartment 10 and comprising a cam contact surface 72, 74, 76;

a cam arm 36 connected to the elevator structure and rotatable about a pivot pin 40, the cam arm 36 having a first side and a second side opposite the first side relative to the pivot pin 40;

an actuator 46 connected to the elevator structure and the first side of the cam arm 36 and configured to rotate the cam arm 36 relative to the pivot pin 40; and a cam arm bearing pin 38 (or simply cam arm bearing 38) connected to the second side of the cam arm and configured to press against the cam contact surface 72, 74, 76 of the cam 12, wherein operation of the actuator 46 when the wheelchair compartment 10 is in the ramp position causes the wheelchair compartment 10 to rise to the safe position.

The wheelchair 50 may be held in place in part by chocks 32. The compartment 10 may have any shape known, such as a bucket shape or a shape similar to the back of a pick-up truck, allowing the wheelchair 50 and its user to be safely contained and transported.

The actuator 46 may be linear or circular or any other kind of actuator. It may be powered electrically, pneumatically, hydraulically, magnetically, or through any other means known. Actuator 46 has a purpose of moving one side of cam arm 36 so allow it to rotate about pivot pin 40.

In one aspect, when the wheelchair compartment 10 is in the safe position, the cam arm 36 is beyond top dead center, whereby a torque must be applied to the cam arm 36 (such as in a direction away from stop region surface 76) to allow the wheelchair compartment to lower to the ramp position. For example, the cam arm 36 might be substantially vertical or even a few degrees beyond vertical (in the direction of stop region surface 76) so that the weight of the compartment 10 keeps the cam arm bearing pin 38 "locked" in the corner between stop region surface 76 and raised region surface 74, so that it requires a torque in the opposite direction (toward and past top dead center) to release the system and lower the compartment 10. This is a safety feature that allows the actuator 46 to fail (or even be removed) without allowing the compartment 10 to fall or be lowered.

In one aspect, the cam contact surface comprises a raising region surface 72, a raised region surface 74, and a stop region surface 76, wherein the cam arm bearing pin 38 presses against the raising region surface 72 while the wheelchair compartment 10 is being raised, wherein the cam arm bearing pin 38 presses against the raised region surface 74 when the wheelchair compartment 10 is in the safe position, and wherein the stop region surface 76 prevents the cam arm bearing pin 38 from moving past the raised region surface 74. The raising region surface 72 may be substantially linear or may be contoured or curved in any way to cause a preferred raising rate/profile of the compartment 10.

The system may comprise a door 52 rotatably connected to the wheelchair compartment 10 about a hinge, the door 52 serving as a wheelchair ramp to the wheelchair compartment 10 when in an open position. The system may further comprise:

a door linkage middle lever 14 rotatable about a second pivot pin 18, the door linkage middle lever 14 having a first linkage side and a second linkage side opposite the first linkage side relative to the second pivot pin 18;

a door linkage front lever 16 connecting the first linkage side of the door linkage middle lever 14 to the first side of the cam arm 36; and a door linkage shaft 64 connecting the second linkage side of the door linkage middle lever 14 to the door 52.

The system may further comprise a door linkage release pin 26 connecting the second linkage side of the door linkage middle lever 14 to the door 52, the door linkage release pin 26 configured to be removed by pulling it, wherein removing the door linkage release pin 26 releases the door 52 to fall open.

In one aspect, the door linkage middle lever 14, the door linkage front lever 16, and the door linkage shaft 64 are sized so that when the wheelchair compartment is in the safe position, the door is in a fully closed position. In one aspect, the door linkage middle lever 14, the door linkage front lever 16, and the door linkage shaft 64 are sized so that when the wheelchair compartment 10 is in the ramp position, the door 52 is in an position, and wherein the lift mechanism is configured so that operation of the actuator 46 when the wheelchair compartment 10 is in the ramp position causes the wheelchair compartment 10 to rise to the safe position and the door 52 to move from the open position to the fully closed position. For example, the door 52 may close continuously as the compartment 10 is raised to the safe position. Alternatively, the door 52 may open continuously as the compartment 10 is lowered to the ramp position.

The system may include a corresponding set on the other side of the compartment 10, including another actuator, cam, and so forth.

The present invention also includes methods of use and operation of the system and apparatus described, such as the method including operating the actuator 46 to cause the compartment to raise and/or lower between the safe position and the ramp position. The method may include operating the actuator so as to cause the wheelchair compartment 10 to rise to the safe position at an approximately constant rate, such as an approximately constant angular rate w, or alternatively the rate may vary, such as slow then fast then slow again (slow at the beginning and ending of motion). The method may include closing the door 52 at a rate to correspond to a rate of raising of the wheelchair compartment 10 so that when the wheelchair compartment 10 is in the ramp position, the door 52 is in the open position, and when the wheelchair compartment 10 is in the safe position, the door 52 is in a fully closed position, such that the door 52 and compartment 10 move at the same time. This can be accomplished by linking the door 52 and compartment 10 together, so that they are both powered by the actuator 46.

The method may also include enabling a user to easily remove the compartment 10 from the elevator structure, such as for easy cleaning, servicing, and/or repair. This can be accomplished by not permanently connecting the compartment 10 to the elevator structure and allowing the compartment 10 to instead rest on elements of the elevator structure. The method may include lifting the wheelchair compartment 10 upward so that the cam arm bearing 38 no longer presses against the cam contact surface of the cam 12 and the wheelchair compartment 10 no longer has contact with the elevator structure.

It should be understood, of course, that the foregoing relates to exemplary embodiments of the invention and that modifications may be made without departing from the spirit and scope of the invention.

What is claimed is:

1. A method of raising a wheelchair compartment from a non-horizontal ramp position to an approximately horizontal safe position, comprising:

a) providing a lift mechanism comprising:

an elevator structure;

a wheelchair compartment configured to hold a wheelchair and rotatable from the ramp position to the safe position;

a cam connected to the compartment and comprising a cam contact surface;

a cam arm connected to the elevator structure and rotatable about a pivot pin, the cam arm having a first side and a second side opposite the first side relative to the pivot pin;

an actuator connected between the elevator structure and the first side of the cam arm and configured to rotate the cam arm relative to the pivot pin; and a cam arm bearing connected to the second side of the cam arm and configured to press against the cam contact surface of the cam; and b) operating the actuator when the wheelchair compartment is in the ramp position so as to cause the wheelchair compartment to rise to the safe position.

2. The method as claimed in claim 1, wherein when the wheelchair compartment is in the safe position, the cam arm is beyond top dead center, whereby a torque must be applied to the cam arm to allow the wheelchair compartment to lower to the ramp position.

3. The method as claimed in claim 1, wherein the lift mechanism further comprises a door rotatably connected to the wheelchair compartment about a hinge, the door serving as a wheelchair ramp to the wheelchair compartment when in an open position.

4. The method as claimed in claim 3, wherein the lift mechanism further comprises a door linkage release pin connected to the door, and wherein the method further comprises pulling the door linkage release pin to release the door to fall open.

5. The method as claimed in claim 3, further comprising closing the door at a rate to correspond to a rate of raising of the wheelchair compartment so that when the wheelchair compartment is in the ramp position, the door is in the open position, and when the wheelchair compartment is in the safe position, the door is in a fully closed position.

6. The method as claimed in claim 3, wherein the door is connected via linkages to the cam arm, and wherein the step of operating the actuator when the wheelchair compartment is in the ramp position also causes the door to close from the open position to a fully closed position.

7. The method as claimed in claim 1, further comprising operating the actuator when the wheelchair compartment is in the safe position so as to cause the wheelchair compartment to lower to the ramp position.

8. The method as claimed in claim 1, wherein the step of operating the actuator comprises operating the actuator so as to cause the wheelchair compartment to rise to the safe position at an approximately constant rate.

9. A method of removing a wheelchair compartment, comprising:

a) providing a lift mechanism for raising a wheelchair compartment from a non-horizontal ramp position to an approximately horizontal safe position, comprising:

an elevator structure;

a wheelchair compartment configured to hold a wheelchair and rotatable from the ramp position to the safe position;

a cam connected to the compartment and comprising a cam contact surface;

a cam arm connected to the elevator structure and rotatable about a pivot pin, the cam arm having a first side and a second side opposite the first side relative to the pivot pin;

an actuator connected between the elevator structure and the first side of the cam arm and configured to rotate the cam arm relative to the pivot pin; and a cam arm bearing connected to the second side of the cam arm and configured to press against the cam contact surface of the cam, wherein operation of the actuator when the wheelchair compartment is in the ramp position causes the wheelchair compartment to rise to the safe position; and b) lifting the wheelchair compartment upward so that the cam arm bearing no longer presses against the cam contact surface of the cam and the wheelchair compartment no longer has contact with the elevator structure.

* * * * *